US006598370B2

(12) United States Patent
Baroncini

(10) Patent No.: US 6,598,370 B2
(45) Date of Patent: Jul. 29, 2003

(54) DEVICE FOR RECOVERING EXCEEDING PRODUCTS FROM A BLISTER BAND IN A BLISTERING MACHINE

(75) Inventor: Ivano Baroncini, Osteria Grande (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 59 days.

(21) Appl. No.: 09/872,553

(22) Filed: Jun. 1, 2001

(65) Prior Publication Data

US 2001/0052218 A1 Dec. 20, 2001

(30) Foreign Application Priority Data

Jun. 5, 2000 (IT) ..... BO2000A0334

(51) Int. Cl.[7] ..... B65B 5/00

(52) U.S. Cl. ..... 53/235; 53/559; 141/115; 198/580

(58) Field of Search ..... 53/509, 158, 559, 53/235, 249, 393; 141/129, 240, 115, 125; 222/216, 218, 345, 346, 352, 371, 414, 411; 198/580, 397.01, 397.06, 598

(56) References Cited

U.S. PATENT DOCUMENTS 1,556,850 A * 10/1925 Kuhne ..... 222/197
2,563,321 A * 8/1951 Dugan ..... 119/57.3
3,656,518 A * 4/1972 Aronson ..... 141/1
3,978,637 A * 9/1976 Mauriello ..... 53/450
4,192,359 A * 3/1980 Pippin ..... 141/12
4,308,942 A * 1/1982 Ackley ..... 198/380
4,576,209 A * 3/1986 Eisenberg ..... 141/1
4,865,092 A * 9/1989 Reichelt ..... 141/280
5,791,127 A * 8/1998 Rossi ..... 53/559
6,053,220 A * 4/2000 Lo et al. ..... 141/129
6,062,438 A * 5/2000 Ellis et al. ..... 222/349
6,311,743 B1 * 11/2001 Baroncini ..... 141/234
6,357,495 B1 * 3/2002 Baroncini ..... 141/129
6,439,426 B1 * 8/2002 Baroncini ..... 221/241

* cited by examiner

*Primary Examiner*—Stephen F. Gerrity
*Assistant Examiner*—John Paradiso
(74) *Attorney, Agent, or Firm*—William J. Sapone; Coleman Sudol Sapone, P.C.

(57) ABSTRACT

In a device for recovering exceeding articles from a blister band on a blistering machine, the blister band is moved in a forward movement direction through a station for feeding the articles to the blisters. A displacing device is situated very close to the blister band for removing exceeding articles while a conveying device recovers the exceeding articles removed from the blister band by the use of a rotating drum. The rotating drum is hollow and has a plurality of radial separating plates defining a number of niches. The niches receive the exceeding articles removed from the blister band and a transport conveyor receives the exceeding articles present in the niches and brings the articles to the feeding station.

5 Claims, 2 Drawing Sheets

DEVICE FOR RECOVERING EXCEEDING PRODUCTS FROM A BLISTER BAND IN A BLISTERING MACHINE

BACKGROUND OF THE INVENTION

The present invention relates to automatic packaging of various articles, in particular tablets, pills, capsules and the like into blister packages.

More particularly, the present invention relates to a device for collecting exceeding products from a blister band in a blistering machine.

DESCRIPTION OF THE PRIOR ART

Pharmaceutical products are usually packaged into blister packs, formed by a plate with a plurality of blisters, which contain the products.

The plate is generally closed by a sheet of e.g. aluminium. The article is removed by breaking the sheet of aluminium. Blister packs are obtained by forming one or more rows of blisters in a continuous band, usually of plastic heat-formable material or aluminium. Then the band passes through a filling station, where one product is introduced into each blister; then the surface with the blisters openings is definitely closed by applying and welding a sheet of aluminium.

The sealed band so obtained is cut into parts containing a selected number of blisters, and consequently products, thus defining blister packs.

Known apparatuses fill the blisters of the blister band according to various techniques.

About this matter, the International Patent Application No. WO 00/07881 and the Italian Patent Application No. BO99A 000667 of the same Applicant, is to be considered.

According to this last mentioned application, the device for feeding articles to a blister band situated thereunder basically includes selecting means, which form a plurality of longitudinal channels receiving articles coming from a conventional feeding hopper situated thereabove.

The selecting means are joined to suitable oscillating means, which generate relative oscillating motion, crosswise and/or lengthwise, between the selecting means and the opposite blister band, so as to facilitate the introduction of products present in the longitudinal channels into the corresponding blisters formed in the band.

This kind of system requires excessive feeding of products; in other words, in a predetermined time interval, the hopper must feed the selecting means with an number of articles much larger than the number of blisters facing a same ideal grid in the same time interval.

Consequently, downstream of the selecting means, the exceeding articles, which are not introduced into the blisters, are usually conveyed to the feeding hopper by suitable collecting means, and then re-introduced in the process.

The collecting means usually include a deflecting brush, which is situated very close to the blister band and which makes the exceeding articles fall on a pocket conveying belt trained around a pair of pulleys and bringing the exceeding articles back into the hopper.

The installation and maintenance of a pocket conveying band is usually very expensive, in particular because it id necessary to obtain a correct tensioning between the two pulleys during operation.

Moreover, the band is usually situated on the front part of the blistering machine, beside the moving blister band, and therefore, it is not only very cumbersome but it does not allow an easy access to the machine during maintenance operations.

SUMMARY OF THE INVENTION

The object of the present invention is to propose a device for recovering exceeding articles, specially tablets, pills and the like, from a blister band in a blistering machine, which resolves the above mentioned problems, ensuring at the same time optimal collection of articles which have not entered the corresponding blisters.

Another object of the present invention is to propose a recovering device, which ensures high reliability and production rate with any operation condition, without affecting the operation of the whole equipment.

A further object of the present invention is to propose a device, which cooperates with blister bands obtained in any way, so as to make it possible the collection of any type of article with any shape or composition as well as to allow particularly rapid and easy production rate adjustments in relation to packaging cycle characteristics of the blistering machine.

A still further object of the present invention is to propose a recovery device, which is obtained by a simple, cheap, extremely functional and reliable technical solution, which ensures an easy and rapid installation and maintenance thereof.

The above mentioned objects are obtained by a device for recovering exceeding articles from a blister band in a blistering machine, with the blister band moving longitudinally through a station for feeding the articles, the device including:

displacing means, situated very close to the blister band for removing exceeding articles from the band; and conveying means for recovering the exceeding articles removed from the blister band;

the conveying means including;

a rotating substantially hollow drum with a circumferential edge and an outer cylindrical surface;

a plurality of radial separating plates disposed along said circumferential edge to define corresponding niches for receiving said exceeding articles removed from said blister band; and transport means cooperating with said drum for receiving said exceeding articles present in said niches and for bringing the articles back to said feeding station.

BRIEF DESCRIPTION OF THE DRAWINGS

The characteristic features of the present invention will be pointed out in the following description of a preferred, but not only embodiment, with reference to the enclosed drawings, in which.

DESCRIPTION OF THE PREFERRED EMBODIMENT

Figure 1:
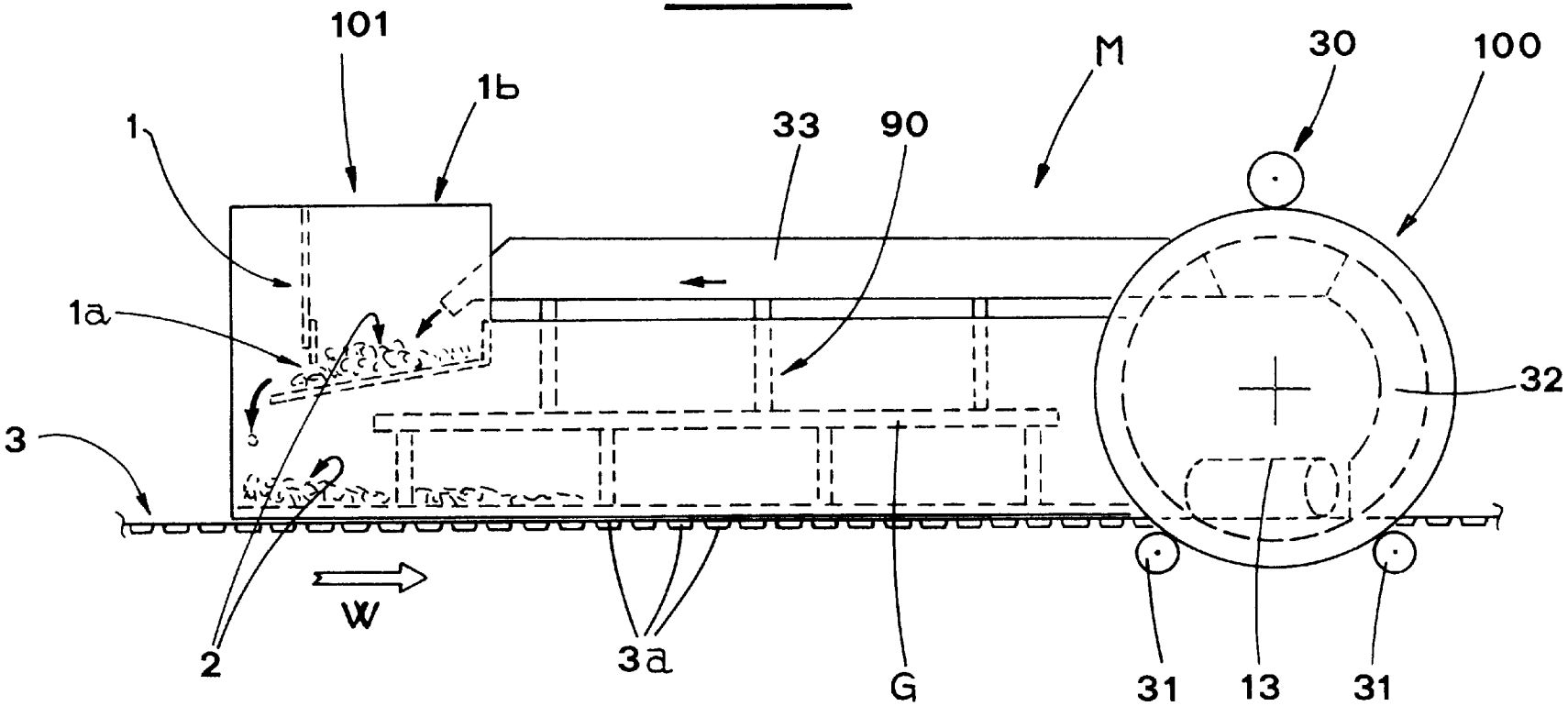
FIG. 1 is a schematic lateral general view of a preferred embodiment of the proposed device in a general operation step.

With reference to the above described figures, the reference numeral 3 indicates a blister band forming a plurality of longitudinal rows of blisters 3*a*, aimed at receiving articles 2 fed by a feeding station 101 of a blistering machine M. The blister band 3, moved longitudinally in a forward movement direction W, is supported and guided by known means, not shown.

A feeding station 101, including e.g. a feeding hopper 1, in which the articles 2 are disposed in bulk, is situated above the blister band 3.

The upper part of the hopper has an inlet portion 1*b* for the articles 2 and its lower part forms an aperture or outlet portion 1*a*, through which the articles 2 go out due to gravity.

The articles 2, which enter into the hopper 1 through the inlet portion 1*b*, come from an upstream container (not shown) or directly from a corresponding longitudinal feeding channel 33, situated in horizontal condition and substantially parallel to the forward movement direction W (FIG. 1).

The articles 2 delivered by the hopper 1 are inserted into the blisters 3*a* formed in the band 3 by means for selecting/sorting the articles 2, e.g. a grid G (shown with broken line in FIG. 1), driven into oscillation.

Figure 2B:
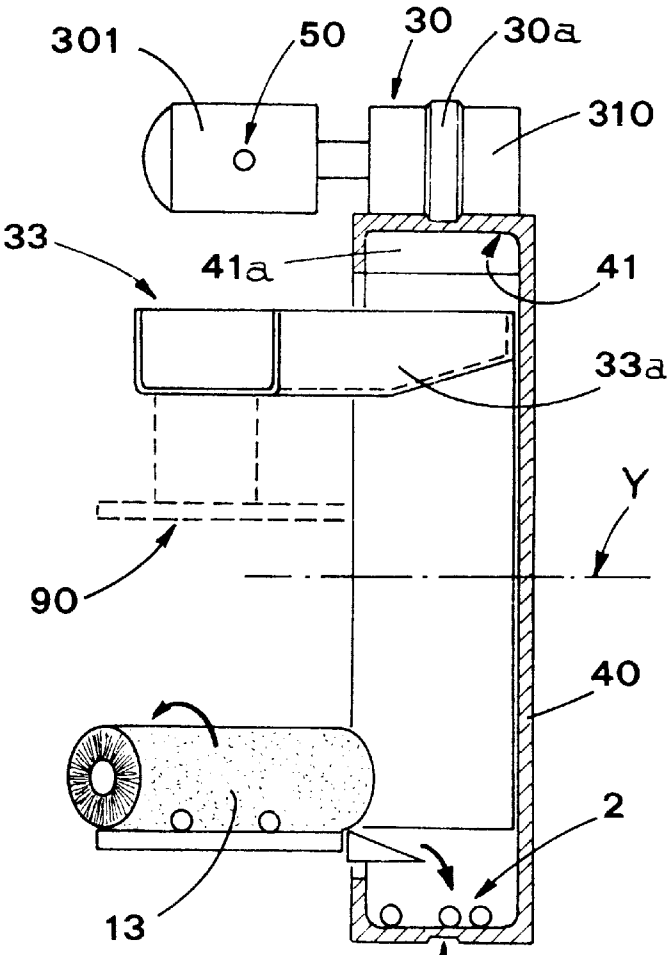
FIG. 2*b* is a schematic front section view, enlarged with respect to the previous Figure, of the element of the FIG. 2*a*.
Figure 2A:
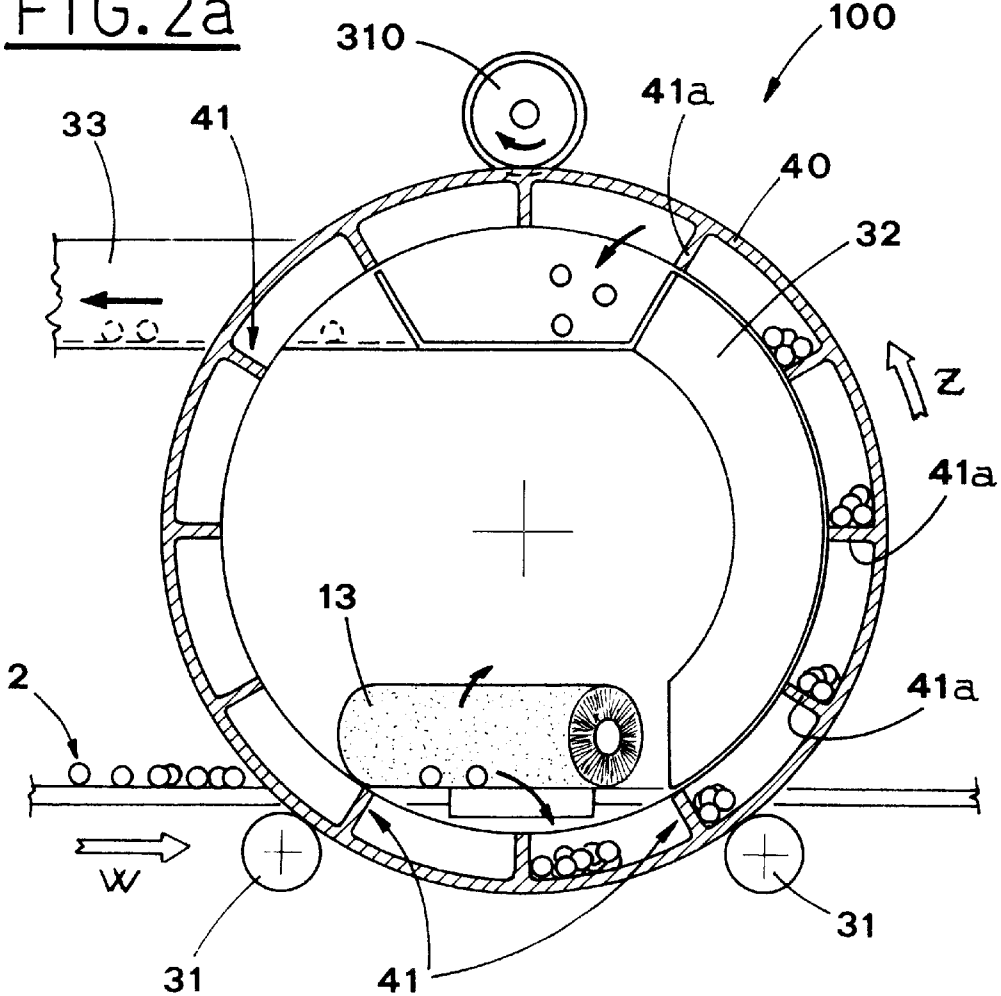
FIG. 2*a* is a schematic lateral view, enlarged with respect to the previous Figure, of a particularly important element of the device.

According to FIGS. 1, 2*a* and 2*b*, a device 100 for recovering exceeding articles 2 from the band 3, i.e. articles 2 which do not enter the corresponding blisters 3*a* of the band 3, is situated downstream of the hopper 1, with respect to the forward movement direction W.

The device 100 includes substantially a brush 13, situated very close to the blister band 3 and aimed at removing therefrom the exceeding articles 2.

The brush 13 cooperates with a rotating drum 40, situated near the brush 13, beside the blister band 3.

The drum 40, rotating continuously in the counterclockwise direction Z, (indicated in FIG. 2*a*), on an axis Y horizontal and orthogonal to direction W of the band 3 forward movement, is hollow and forms, along its edge, a plurality of radial separating plates 41*a*, which define corresponding niches 41 (FIG. 2*a*).

The niches 41 receive, when passing near the brush 13, the articles 2 removed from the band 3 and falling therefrom, and release them, at the level higher than the band 3, to the longitudinal channel 33 opening into the inlet portion 1*b* of the hopper 1.

Downstream of the brush 13, the rotating drum 40 cooperates with a stationary annulus sector or retainer section 32, which is aimed at closing the niches 41 facing it during the drum 40 rotation, so as to prevent the articles 2, picked up near the brush 13, from leaving the niches due to the gravity, and at releasing the articles 2 into the longitudinal channel 33 through a suitable slide 33*a*.

The lower part of the rotating drum 40 is supported and stabilized by at least a pair of opposite rollers 31, rotating idly on axes parallel to the rotation axis Y of the rotating drum 40.

The drum 40 is rotated continuously in direction Z by corresponding driving means 30, acting in the region of the outer surface of the drum 40 and over it (FIG. 2*b*). The driving means 30 include, e.g. an actuator 301 with a rotor 310 is constantly in contact with the outer surface of the drum 40, so as to rotate it by friction, (FIG. 2*b*).

The actuator 301 is supported by a shaft 50, so that it can be driven, by known and not shown means, to move between a working position, in which the rotor 310 touches the outer edge surface of the drum 40 and causes rotation thereof, as shown in FIG. 2*b*, and a raised rest position (not shown), in which the rotor 310 does not touch the outer edge surface of the drum 40, thus releasing the drum 40 from any constraint, and consequently allowing it to be detached from the rollers 31 and removed, e.g. for some rapid maintenance operations of the machine M and/or the band 3 and/or the drum 40.

A circumferential groove 42 is made in the outer surface of the drum 40 for free engagement with a corresponding crown 30*a* of the rotor 310 of the actuator 301, so as to prevent axial displacements of the rotating drum 40.

The shape of the crown 30*a* is complementary to the shape of the groove 42.

The operation of the proposed device 100 for recovering exceeding articles 2 from a blister band 3 is described in the following with reference to an intermediate operation configuration, in which the actuator 301 drives the rotating drum 40 to rotate in direction Z.

The brush 13 catches the exceeding articles 2, i.e. the articles which do not enter relative blisters 3*a* during the blister band 3 forward movement in direction W, and displaces them laterally with respect to the blister band 3.

Downstream of the brush 13, the blister band 3 features longitudinal rows of blisters 3*a* each filled with an article 2; this means that there are no articles 2 left out of the blisters 3*a* of the blister band 3.

The exceeding articles 2 removed from the blister band 3 fall, due to the gravity, into the niches 41 of the rotating drum 40, which are near the brush 13.

The continuous rotation of the drum 40 in direction Z gradually brings the niches 41 to face gradually the retainer section 32, thus closing them from above.

This allows to hold the articles 2 within the niches 41 with a selected angular portion, substantially defined by the extension of the retainer section 32.

Obviously, closing of the niches 41 prevents the articles 2, picked up near the brush 13, from going out because of gravity.

The continuous rotation of the drum 40 in direction Z brings the articles 2 to a height near to the level of the longitudinal channel 33.

The niches 41 are gradually opened by the angular displacement of the retainer section 32 and consequently, the articles contained therein fall, due to the gravity, onto the longitudinal channel 33 through the slide 33*a*.

Thus, the articles 2 exceeding on the band 3, laterally displaced by the brush 13, are conveyed on the longitudinal channel 33, and then introduced again into the hopper 1.

This is made possible by holding the articles 2 within the niches 41 of the rotating drum 40, which are closed by the retainer section 32, so as to prevent the articles 2 from going out due to gravity, and by releasing the articles 2 in the region of the longitudinal channel 33, at a level higher than the band 3.

The transport of the articles 2 inside the longitudinal channel 33 to the hopper 1 is facilitated by oscillating means 90, which drive the longitudinal channel 33 into oscillation. This does not exclude a slight inclination of the longitudinal channel 33 with respect to the plane defined by the band 3, so as to facilitate the transport of the articles 2 contained therein to the hopper 1 due to the gravity.

The proposed device 100 for recovering exceeding articles 2 from the blister band 3 is particularly indicated for capsules, tablets and pills of any shape.

The described device 100 ensures optimal recovering of the articles which do not enter corresponding blisters 3*a*, avoiding any damage to both the treated articles 2 and the blister band 3, independently from the shape and size of the articles 2 and the relative blisters 3*a*.

In particular, the rotating drum 40 does not include a motor shaft, and consequently it does not include corresponding bearings, which allows to reduce, simplify and speed up any installation and/or maintenance procedure, thus reducing considerably their costs.

The necessary rotation of the drum 40 is obtained by particularly simple driving means 30, which are mainly based on the considerable friction between the rotor 310 of the actuator and the outer surface of the drum 40.

Moreover, the position of the drum 40 between the pair of opposite idle rollers 31 and the means 30 allows the drum to be disassembled and/or substituted during the blistering machine M stops, e.g. in case the type of articles 2 is changed or drum 40 maintenance operations must be performed. Moreover, it is to be pointed out that the above described device is formed by few simple elements, which is advantageous for production costs, which are thus very low.

It is understood that what above, has been described as a pure, not limitative example, therefore, possible variants of the invention remain within the protective scope of the present technical solution, as described above and claimed hereinafter.

What is claimed is:

1. A Device for recovering exceeding articles from a blister band in a blistering machine, with the blister band moving longitudinally through a station for feeding the articles, the device including:

displacing means, situated very close to the blister band for removing exceeding articles from the band; and conveying means for recovering the exceeding articles removed from the blister band;

the conveying means including;

a rotating substantially hollow drum with a circumferential edge and an outer cylindrical surface;

a plurality of radial separating plates disposed along said circumferential edge to define corresponding niches for receiving said exceeding articles removed from said blister band; and transport means cooperating with said drum for receiving said exceeding articles present in said niches and for bringing the articles back to said feeding station.

2. A device as in claim 1, including roller means for supporting said drum and driving means for driving said drum into rotation.

3. A device as in claim 2, wherein said driving means include:

an actuator with a rotor that touches said outer cylindrical surface of said drum;

a shaft for pivotal supporting of said actuator, said actuator being moved between a working position, in which the rotor touches said outer surface of said drum, and a raised rest position, in which said rotor does not touch the outer cylindrical surface of said drum.

4. A device as in claim 3, wherein said outer cylindrical surface of said drum features a circumferential groove, which engages freely with a corresponding crown, situated on said rotor, said crown being complementary to said groove.

5. A device as in claim 1, further including oscillating means coupled with said conveying means so as to facilitate transporting said articles along said conveying means toward said feeding station.

* * * * *